US012779615B2

(12) United States Patent
Deng et al.

(10) Patent No.: US 12,779,615 B2
(45) Date of Patent: Nov. 3, 2026

(54) GRINDING SANDER

(71) Applicant: ABB Schweiz AG, Baden (CH)

(72) Inventors: Wenhui Deng, Zhuhai Guangdong (CN); Hao Wang, Shenzhen Guangdong (CN); Haoxu Wan, Shanghai (CN); Yi Ding, Shanghai (CN)

(73) Assignee: ABB Schweiz AG, Baden (CH)

( * ) Notice: Subject to any disclaimer, the term of this patent is extended or adjusted under 35 U.S.C. 154(b) by 468 days.

(21) Appl. No.: 18/315,826

(22) Filed: May 11, 2023

(65) Prior Publication Data

US 2023/0381909 A1 Nov. 30, 2023

(30) Foreign Application Priority Data

May 24, 2022 (CN) ..... 202210573381.7

(51) Int. Cl.
*B24B 7/02* (2006.01)
*B24B 41/00* (2006.01)

(52) U.S. Cl.
CPC ..... *B24B 7/02* (2013.01); *B24B 41/002* (2013.01)

(58) Field of Classification Search
CPC ..... B24D 15/023; B24D 15/04; B24D 9/085
USPC ..... 451/502, 530
See application file for complete search history.

(56) References Cited

U.S. PATENT DOCUMENTS 4,920,702 A * 5/1990 Kloss ..... B24D 9/08 15/97.1
6,048,257 A * 4/2000 Greenman ..... B24B 19/06 451/163
7,048,618 B1 * 5/2006 Cramer ..... B24D 15/023 451/525
9,358,670 B2 * 6/2016 Kolthoff ..... B24D 9/08
2005/0260940 A1 11/2005 Palushaj

FOREIGN PATENT DOCUMENTS

| | | | |
|---|---|---|---|
| CA | 2 891 156 | A1 | 11/2015 |
| CN | 108214334 | A | 6/2018 |
| CN | 207710455 | U | 8/2018 |
| CN | 210115786 | U | 2/2020 |
| CN | 210849864 | U | 6/2020 |
| CN | 211073244 | U | 7/2020 |
| CN | 111604741 | A | 9/2020 |
| CN | 212420891 | U | 1/2021 |

(Continued)

OTHER PUBLICATIONS

Chinese Office Action; Application No. 2022105733817; Issued: Aug. 26, 2026; 4 Pages.

*Primary Examiner* — Makena S Markman
(74) *Attorney, Agent, or Firm* — Whitmyer IP Group LLC

(57) ABSTRACT

The present disclosure relates to a grinding sander. The grinding sander includes a sanding plate configured to move in an operation state, and a plurality of limiting members disposed on a surface of the sanding plate to define a plurality of strip-shaped slot areas. Each strip-shaped slot area is configured to allow at least one strip-shaped sandpaper to be correspondingly mounted therein to effect sanding of a surface of an article via the strip-shaped sandpaper under the movement of the sanding plate. The grinding sander of the present disclosure may be used to perform high-quality sanding of a narrow surface of an article.

16 Claims, 3 Drawing Sheets

(56) References Cited

FOREIGN PATENT DOCUMENTS

| | | | |
|---|---|---|---|
| CN | 217371917 | U | 9/2022 |
| DE | 2411749 | A1 | 9/1975 |
| KR | 10-1385306 | B1 | 11/2012 |
| SU | 975375 | A1 | 11/1982 |

* cited by examiner

GRINDING SANDER

CROSS-REFERENCE TO RELATED APPLICATIONS

This application claims priority to Chinese patent application Serial No.: 202210573381.7, filed on May 24, 2022; which is herein incorporated by reference in its entirety.

FIELD

The present disclosure relates to a field of grinding sanders, and more specifically to a grinding sander using strip-shaped sandpapers for grinding.

BACKGROUND

Grinding sanders are widely applied in the industry, for example, for grinding or polishing surfaces of materials such as metal, wood and plastic. In addition, the grinding sanders may also achieve treatment of defects of sheet materials and effective cleaning of the plate surfaces.

According to the power classification, the grinding sanders may be classified into pneumatic sanders and electric sanders. Typically, a sandpaper is attached to a sanding plate, wherein the sanding plate may be actuated to move in an operation state. In this case, the grinding of the surface of an article may be achieved using the sandpaper in a moving state of the sanding plate.

SUMMARY

One of objects of the present disclosure to provide an improved grinding sander which may solve the technical problem of high-quality sanding against a narrow surface.

According to one aspect of the present disclosure, there is provided a grinding sander. The grinding sander comprises: a sanding plate configured to move in an operation state; and a plurality of limiting members disposed on a surface of the sanding plate to define a plurality of strip-shaped slot areas, wherein each strip-shaped slot area is defined to allow at least one strip-shaped sandpaper to be correspondingly mounted therein to effect sanding of a surface of an article via the strip-shaped sandpaper under the movement of the sanding plate.

With the above sander, a narrow strip-shaped sandpaper may be used to sand a narrow article surface. In this manner, as compared with the conventional manner of using a large piece of sandpaper, the manner in the present disclosure may reduce the possibility of the warping of the edges of the strip-shaped sandpaper, thereby avoiding a case caused by the warping in which the edges of the sanded narrow surface collapse and a middle part is missed out, significantly improving the sanding effect and meanwhile reducing the waste of the sandpaper.

In some embodiments, the plurality of limiting members are disposed parallel to one another on the surface of the sanding plate to define a plurality of strip-shaped slot areas parallel to one another. In these embodiments, it may be more convenient to sand narrow surfaces that are relatively regular in shape, while facilitating trimming and mounting of the strip-shaped sandpaper.

In some embodiments, a depth of the strip-shaped slot area is less than a thickness of the strip-shaped sandpaper intended to be mounted. In this way, the surface of the article may be prevented from touching the limiting members when grinding.

In some embodiments, the limiting member is a hard stop removably secured to a surface of the sanding plate by screws. In this manner, the limiting members may be detached conveniently.

In some embodiments, the plurality of limiting members are integrally formed with the surface of the sanding plate. In these embodiments, the step of additionally installing the limiting members may be avoided.

In some embodiments, the grinding sander further comprises: a hook and loop fastener comprising a plurality of hook and loop areas, each hook and loop area correspondingly covering a bottom surface of each strip-shaped slot area so that each strip-shaped sandpaper can be fixed to the hook and loop area in the corresponding strip-shaped slot area with the hook and loop fastener. In this way, the strip-shaped sandpaper may be attached to the hook and loop area in a detachable manner, so that the replacement of the strip-shaped sandpaper is very simple.

In some embodiments, the hook and loop fastener further comprises a plurality of fastening areas sandwiched between the plurality of limiting members and the surface of the sanding plate. In this way, the hook and loop fastener can be mounted more firmly on the surface of the sanding plate, thereby avoiding displacement during the sanding.

In some embodiments, the hook and loop fastener is a one-piece member.

In some embodiments, an aspect ratio of the strip-shaped slot area is larger than 5.

In some embodiments, the strip-shaped sandpaper is adhesively secured to the bottom of the strip-shaped slot area. This provides an alternative manner of mounting the strip-shaped sandpaper.

In some embodiments, the grinding sander is a flat plate sander, the sanding plate is a plane, and the movement comprises vibration in the plane.

In some embodiments, the grinding sander is a pneumatic sander.

It should be appreciated that this Summary is not intended to identify key features or essential features of embodiments of the present disclosure, nor is it intended to be used to limit the scope of the present disclosure. Other features of embodiments of the present disclosure will become apparent through the following depictions.

BRIEF DESCRIPTION OF THE DRAWINGS

Through the following detailed description with reference to the accompanying drawings, the above and other features, advantages and aspects of embodiments of the present disclosure will become more apparent. In the figures, the same or like reference numbers denote the same or like elements, wherein.

DETAILED DESCRIPTION OF EMBODIMENTS

Embodiments of the present disclosure will be described in more detail below with reference to the figures. While certain embodiments of the present disclosure are shown in the figures, it should be appreciated that the present disclosure may be implemented in various forms and should not be construed as being limited to the embodiments set forth herein, and instead, these embodiments are provided to enable more thorough and complete understanding of the present disclosure. It should be appreciated that the figures and embodiments of the present disclosure are only for exemplary purposes, and are not intended to limit the protection scope of the present disclosure.

As previously mentioned, grinding sanders are widely applied in the industry. However, the inventors have noted that when a sander is used to grind a relatively narrow surface of an article, such as a rim of a cell phone case, the existing layout of a sanding plate and a sandpaper of a conventional sander (e.g., in such a case a whole piece of sandpaper is usually simply fixed on a sanding plate such as a flat plate) might not achieve excellent grinding of the narrow surface of the article.

Figure 1:
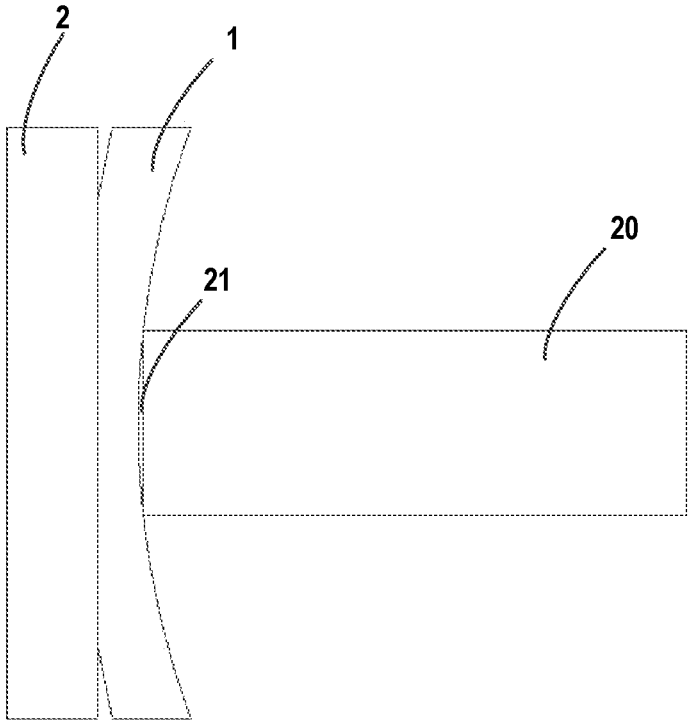
FIG. 1 shows a schematic view of using a conventional grinding sander to grind a narrow article surface.

Specifically, FIG. 1 shows a schematic view of using a conventional grinding sander to grind a narrow article surface. As shown in FIG. 1, a large sheet of sandpaper 1 is attached to the surface of a sanding plate 2 of a sander. As is well known, a conventionally-used sandpaper 1 (e.g., 3M pyramid-type sandpaper) has a certain thickness (e.g., 3-10 mm) and is not completely rigid. Therefore, when a narrow surface 21 of an article 20 (such as a rim of a cell phone case) is sanded against the surface of a large sheet of sandpaper 1, the sandpaper 1 will have a significant warping deformation at the edge due to being pressed by edges and corners of the narrow surface 21, as shown in FIG. 1. As can be readily appreciated, such warping deformation might cause the edges of the sanded narrow surface to collapse and a middle part to be missed out, which is undesirable.

In order to solve the above-mentioned problem occurring in the sanding of the narrow article surface, a concept of the present disclosure is that a plurality of limiting members are provided on the surface of the sanding plate to define a plurality of strip-shaped slot areas, wherein each strip-shaped slot area may allow at least one strip-shaped sandpaper to be correspondingly installed therein to achieve sanding of the narrow article surface with the installed strip-shaped sandpaper. It will be readily appreciated that a width of the strip-shaped sandpaper is substantially reduced as compared with the width dimension of a conventionally-used sandpaper, which reduces the possibility of the warping of the edges of the strip-shaped sandpaper, thereby avoiding the case caused by the warping in which the edges of the sanded narrow surface collapse and a middle part is missed out, and significantly improving the sanding effect.

Figure 2:
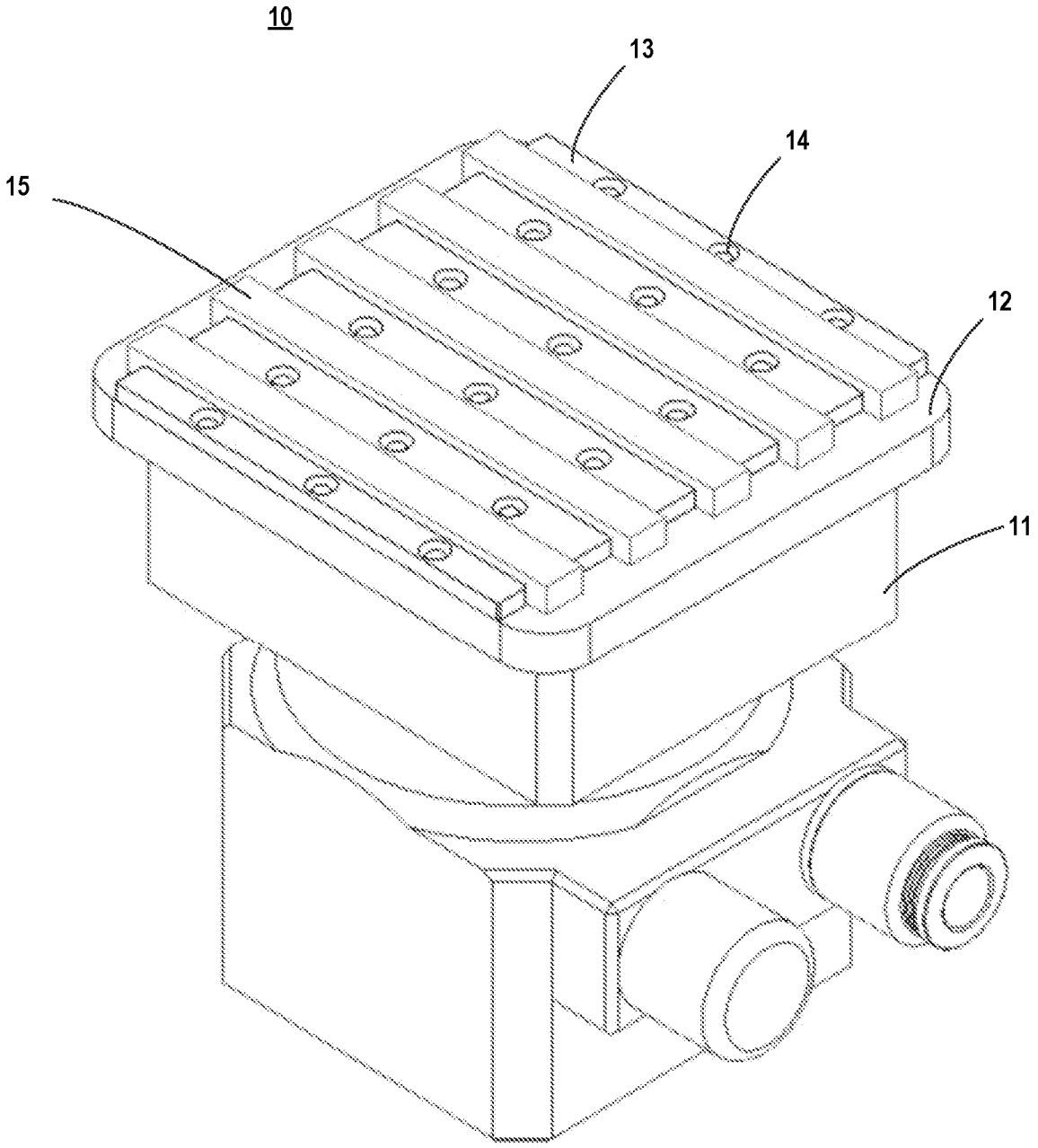
FIG. 2 shows a schematic perspective view of a grinding sander according to an exemplary embodiment of the present disclosure.

As an exemplary description, FIG. 2 shows a schematic perspective view of a grinding sander according to an exemplary embodiment of the present disclosure.

As shown in FIG. 2, a sander 10 may comprise a sander body 11, and a sanding plate 12 disposed on the sander body 11. By way of example only, FIG. 2 illustrates the appearance of a pneumatic sander. However, it will be appreciated that the sander 10 may also be an electric sander. In addition, in some embodiments, the surface of the sanding plate 12 may be a plane, which facilitates the planar arrangement of the sandpaper mounted on the surface of the sanding plate 12, and which may be desirable for some applications. However, this is not limiting, and in some special applications, the surface of the sanding plate 12 is not a plane, and might be formed as a curved surface so that the sandpaper mounted on the surface of the sanding plate 12 is within the curved surface to meet the needs of the special application.

Regardless of the type of the sanders, the sanding plate 12 may be actuated in an operation state to move with a certain amplitude, such as a reciprocating movement. By this movement, the sandpaper mounted thereon can be brought to effect mechanical sanding of the surface of the article to be sanded. Just as one exemplary implementation of the reciprocating movement described above, the sanding plate 12 may periodically vibrate, for example, under the action of an internal eccentric wheel, and the amplitude may be relatively small (e.g., less than 1 mm in amplitude). As another exemplary implementation of the reciprocating movement described above, the sanding plate 12 may reciprocate back and forth in a straight line. It should be understood that the type of movement in the present disclosure may depend on the grinding effect to be achieved, and the specific type and specific implementation of the movement is not limited by the present disclosure herein. For example, for a specific application such as the sanding of the surface of a cell phone case, it might be preferable to have the sanding plate 12 in a planar form and cause the sanding plate 12 vibrate within a plane.

A plurality of limiting members 13 may be provided on the surface of the sanding plate 12 to define a plurality of strip-shaped slot areas. Each strip-shaped slot area may be sized and configured to allow at least one strip-shaped sandpaper 15 to be correspondingly installed therein. It is noted that generally, each strip-shaped slot area is defined to allow one strip-shaped sandpaper 15 to be mounted therein correspondingly, but in some special cases, a plurality of strip-shaped sandpaper may be arranged in series or in parallel in one strip-shaped slot.

By way of example only, the limiting member 13 may be a strip-shaped block, wherein any two adjacent strip-shaped blocks may define a strip-shaped slot area. As another example, the limiting member 13 may be a positioning pin or bump that may protrude from the surface of the sanding plate 12, thereby defining a plurality of strip-shaped slot areas.

It will be appreciated that the function of the plurality of limiting members 13 is to limit the position of the strip-shaped sandpaper to be mounted. Here, the present disclosure does not limit the specific formation structure of the plurality of limiting members 13 as long as they can define the strip-shaped slot area and limit the position of the strip-shaped sandpaper. Thus, in some embodiments, the limiting member defining either side of each strip-shaped slot area may be integrally formed (e.g., a single strip-shaped component) or may be discrete (e.g., the limiting member on one side of the strip-shaped slot area may be formed by a plurality of discrete positioning bumps or positioning pins). In yet some embodiments, the limiting member 13 and sanding plate 12 may be parts that are detachable and separable from each other, or may be integrally formed with the sanding plate 12, or a combination thereof. In particular, in an embodiment where the limiting member 13 and the sanding plate 12 are detachable and separable from each other, the limiting member 13 may be secured to the sanding plate 12 by screws 14.

In some embodiments, a plurality of limiting members 13 may be disposed parallel to one another on the surface of the sanding plate to define a plurality of strip-shaped slot areas parallel to one another such that a plurality of strip-shaped sandpaper may be mounted parallel to one another within the plurality of strip-shaped slot areas. In particular, each strip-shaped sandpaper may be mounted in one strip-shaped slot area, correspondingly. This may be advantageous for sanding the surface of an article such as the rim of the cell phone case. However, it should be appreciated that non-parallel arrangement of the plurality of limiting members 13, the plurality of strip-shaped slot areas, or the plurality of strip-shaped sandpapers 15 is also possible, depending on the needs of specific application.

In some embodiments, a plurality of strip-shaped sandpaper 15 may be attached to a bottom of a plurality of strip slot areas. By way of example, the above attachment may be performed by using an adhesive, for example. As another example, the attachment may be performed by a hook and loop fastener.

In embodiments where attachment is performed by a hook and loop fastener, the sander 10 may comprise a hook and loop fastener (not shown), which may comprise a plurality of hook and loop areas, each of which may correspondingly cover the bottom of each strip-shaped slot area. In some embodiments, the bottom of each strip-shaped slot area may be a portion of the surface of the sanding plate described above. In particular, the above-mentioned hook and loop area may be formed as a hook surface of the hook and loop fastener, and a back surface of the strip-shaped sandpaper may be formed as a loop surface of the hook and loop fastener. In this way, the strip-shaped sandpaper may be attached to the bottom in the strip-shaped slot area by the engagement of the loop surface and hook surface. It is easy to understand that the quick replacement of the strip-shaped sandpaper may be facilitated by the attachment of the hook and loop fastener.

In order to ensure that the plurality of hook and loop areas cover tightly the bottom in each strip-shaped slot area without displacement, in some embodiments, the hook and loop fastener may also be firmly attached to the bottom in each strip-shaped slot area via fixing means such as glue, screws or the like. In yet some embodiments, where the limiting member 13 and the sanding plate 12 are parts that are detachable and separable from each other, the hook and loop fastener may further comprise a plurality of fastening areas, which may be secured between said plurality of limiting members 13 and the surface of said sanding plate 12. Especially, the plurality of hook and loop areas and the plurality of fastening areas of the above-mentioned hook and loop fastener can be formed integrally, i.e., the above-mentioned hook and loop fastener be a one-piece member.

Merely by way of example, in a process of mounting the hook and loop fastener as one-piece member described above, the hook and loop fastener may be first placed on the surface of the sanding plate 12, then the fastening areas are aligned with positions of the plurality of limiting members 13 on the sanding plate 12, the plurality of hook and loop areas are aligned with the plurality of strip-shaped slot areas, and then the plurality of fastening areas are secured between the plurality of limiting members 13 and the surface of the sanding plate 12 via the screws 14. It will be readily appreciated that the use of the integral hook and loop fastener and corresponding mounting manner described above may enable the hook and loop fastener to be fixedly attached to the surface of the sanding plate 13 without loosening in response to movement (e.g., high-frequency vibration) of the sanding plate 13, thereby preventing the displacement of the strip-shaped sandpapers attached thereto during sanding.

According to various embodiments of the present disclosure, the size or spacing of the strip-shaped slot areas described above may be customized according to the size of the strip-shaped sandpapers to be mounted. In particular, a width of the strip-shaped slot area may be customized to be slightly larger than the width of the strip-shaped sandpaper to be mounted, a length may be substantially equal to the length of each strip-shaped sandpaper, and a depth may be less than a thickness of the strip-shaped sandpaper.

It should be mentioned here in particular that the depth of the strip-shaped slot area is smaller than the thickness of the strip-shaped sandpaper, which means that when the strip-shaped sandpaper is mounted in the strip-shaped slot area, the height of an upper surface of the strip-shaped sandpaper 15 relative to the surface of the sanding plate 12 may be made higher than the height of the upper surface of the limiting member 13 relative to the surface of the sanding plate 12, which may prevent the surface of the article from touching the limiting member 12 when sanding of the strip-shaped sandpaper.

In addition, the size of the strip-shaped slot area or the strip-shaped sandpaper may be adaptively adjusted according to different applications. For example, differently-sized strip slot areas and strip-shaped sandpapers may be customized for differently-sized strip article surfaces. For example, the size of the strip-shaped slot area and the strip-shaped sandpaper customized for sanding the rim of the cell phone case may be different from the size of the strip-shaped slot area and the strip-shaped sandpaper customized for sanding the rim of a PAD. However, a length-width ratio or aspect ratio of the strip-shaped slot area and the strip-shaped sandpaper may be much larger than 1. In some embodiments, the aspect ratio of both the strip-shaped slot area and the strip-shaped sandpaper may be larger than 3, 4, 5, 6, 7, 8, 9, 10, 15, 20, etc.

By way of example only, the strip-shaped sandpaper 14 to be mounted may have a length for example in a range of 20-160 mm, a width for example in a range of 4-10 mm, and a thickness for example in a range of 3-10 mm. In particular, the strip-shaped sandpaper may have a length for example in a range of 50-80 mm, a width for example in a range of 5-8 mm and a thickness for example in a range of 4-6 mm. The length, width and depth of the strip-shaped slot area may be adaptively changed according to the length, width and thickness of the strip-shaped sandpaper.

In some embodiments, the length and thickness of the limiting member 13 may determine the length and depth of the strip-shaped slot area, respectively. For example, the length and thickness of the limiting member 13 may be substantially equal to the length and depth of the strip-shaped slot area. In yet some embodiments, the width of the limiting member 13 may determine an adjoining distance between adjacent strip-shaped slot areas or adjacent strip-shaped sandpapers. It should be noted herein that the width of the limiting member 13 (or the adjoining distance determined thereby) may be determined based on an amplitude of the reciprocating movement of the sanding plate 12 and an amplitude of the operation of, for example, a robot when performing sanding on a single strip-shaped sandpaper.

By way of example only, the limiting member 13 may have a length in a range of a width in a range of 4 mm-30 mm and a thickness in a range of 2 mm-9 mm. In particular, the limiting member 13 may have a length in a range from 50 mm to 80 mm, a width in a range from 6 mm to 12 mm, and a thickness in a range from 3 mm to 5 mm.

Figure 3:
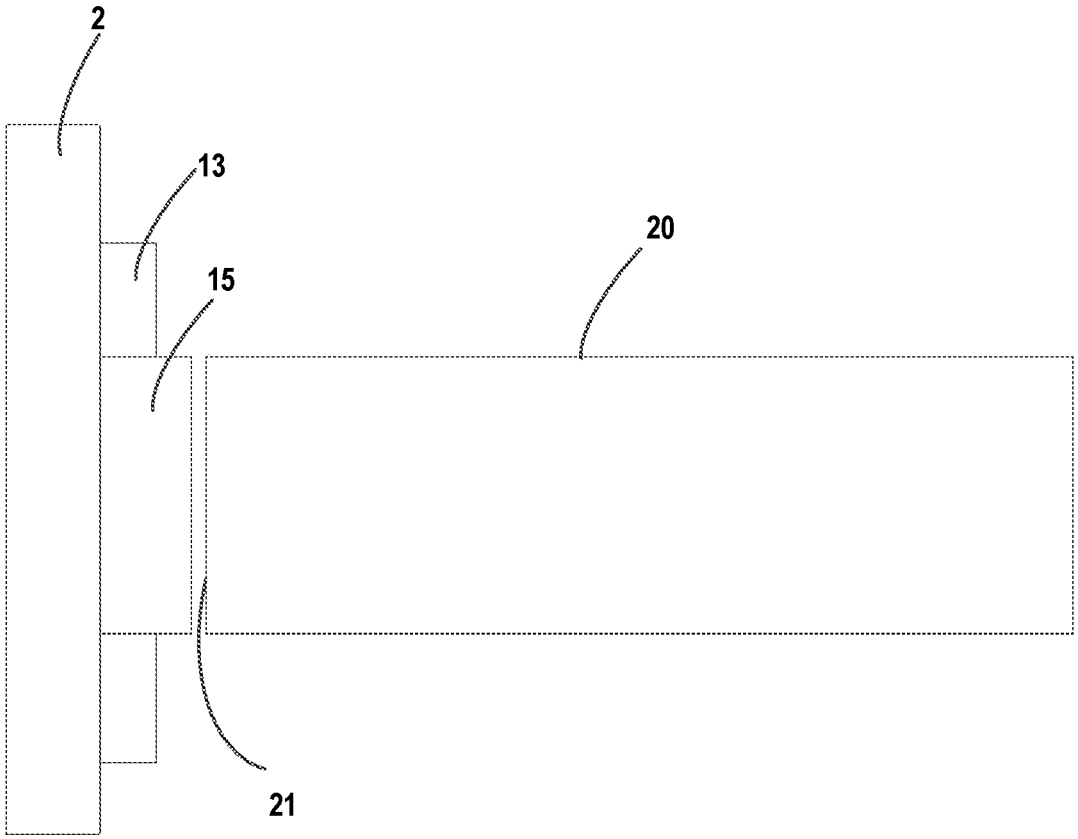
FIG. 3 shows a schematic illustration of grinding a narrow article surface using a grinding sander according to an exemplary embodiment of the present disclosure.

FIG. 3 shows a schematic illustration of grinding a narrow article surface using a grinding sander according to an exemplary embodiment of the present disclosure.

As shown in FIG. 3, a narrow surface 21 of an article 20 (e.g., a rim of a cell phone case) intended to be sanded may be sanded against the surface of a strip-shaped sandpaper 15. It will be readily appreciated that since the size of the strip-shaped sandpaper 15 is tailored to the narrow surface 21 to be sanded, the length and width of the strip-shaped sandpaper 15 may be tailored to be substantially equal to the length and width of the narrow surface 21. In this case, when the narrow surface 21 of the article is sanded against the surface of the strip-shaped sandpaper 15, edges of the strip-shaped sandpaper 15 will be substantially in contact with the narrow surface 21 and sanded. This may effectively avoid warping deformation of the edges of the strip-shaped sandpaper 15 under pressing, and meanwhile may prevent the case in which the edges of the sanded narrow surface 21 collapse and a middle part is missed out. In other words, the surface may be sanded more uniformly and sufficiently.

It will also be readily appreciated that because the size of the strip-shaped sandpaper 15 is close to the size of the narrow surface 21 that is intended to be sanded, this may improve the sanding efficiency of each strip-shaped sandpaper 15 and save costs. Thus, in some embodiments, the strip-shaped sandpapers on the sanding plate 12 may be used one by one for sanding. That is, after the strip-shaped sandpaper in one strip-shaped slot area is used up, the strip-shaped sandpaper in next strip-shaped slot area will be used until all strip-shaped sandpapers on the sanding plate have been consumed. Once all the strip-shaped sandpapers have been consumed, all the strip-shaped sandpapers on the sanding plate may be replaced and the next sanding operation may be started. Through the above-described sanding manner, the strip-shaped sandpapers on the sanding plate may be used more efficiently.

In addition, the provision of the limiting members 15 on both sides of the strip-shaped sandpaper 15 may also facilitate the positioning of the sandpaper and the stability during sanding.

While the present invention has been illustrated and described in detail in the accompanying drawings and the foregoing description, such illustration and description are to be considered illustrative or exemplary and not restrictive; the present invention is not limited to the disclosed embodiments. Other variations to the disclosed embodiments may be understood and practiced by those skilled in the art by studying the figures, disclosure and the appended claims upon practicing the claimed invention.

In the claims, the word "comprise" does not exclude other elements, and indefinite articles "a" and "an" do not exclude a plurality. A single element or other unit may fulfill the functions of several items recited in the claims. The mere fact that certain features are recited in mutually different dependent claims or described in different embodiments does not indicate that a combination of these features cannot be used to advantage. The protection scope of the present application covers any possible combination of various features recited in the embodiments or dependent claims without departing from the spirit and scope of the present application.

In addition, any reference signs in the claims should not be construed as limiting the scope of the invention.

We claim:

1. A grinding sander, comprising:

a sanding plate configured to move in an operation state; and a plurality of limiting members configured to define a plurality of strip-shaped slot areas, wherein each strip-shaped slot area is defined to allow at least one strip-shaped sandpaper to be correspondingly mounted therein to effect sanding of a surface of an article via the strip-shaped sandpaper under the movement of the sanding plate, a hook and loop fastener including a plurality of hook and loop areas, each of the hook and loop areas correspondingly covering a bottom surface of each strip-shaped slot area so that each strip-shaped sandpaper can be fixed to the plurality of hook and loop areas in the corresponding strip-shaped slot area with the hook and loop fastener, wherein the hook and loop fastener further comprises a plurality of fastening areas disposed between each of the plurality of limiting members and the surface of the sanding plate.

2. The grinding sander according to claim 1, wherein the plurality of limiting members are disposed parallel to one another on the surface of the sanding plate to define the plurality of strip-shaped slot areas parallel to one another.

3. The grinding sander according to claim 2, further comprising the at least one strip-shaped sandpaper;

wherein a depth of each of the plurality of strip-shaped slot areas is less than a thickness of the at least one strip-shaped sandpaper, wherein the thickness corresponds to a height direction of the at least one strip-shaped sandpaper.

4. The grinding sander according to claim 3, wherein the plurality of limiting members are integrally formed with the surface of the sanding plate.

5. The grinding sander according to claim 3, wherein each of the plurality of limiting members is a hard stop removably secured to the surface of the sanding plate by screws.

6. The grinding sander according to claim 2, wherein each of the plurality of limiting members is a hard stop removably secured to the surface of the sanding plate by screws.

7. The grinding sander according to claim 2, wherein an aspect ratio (length to width) of each strip-shaped slot area is larger than 5 to 1.

8. The grinding sander according to claim 2, wherein the strip-shaped sandpaper is adhesively secured to the bottom of the strip-shaped slot area.

9. The grinding sander according to claim 2, wherein the grinding sander is a flat plate sander, the sanding plate is a plane, and the movement comprises vibration in the plane.

10. The grinding sander according to claim 2, wherein the grinding sander is a pneumatic sander.

11. The grinding sander according to claim 1, wherein each of the plurality of limiting members is a hard stop removably secured to the surface of the sanding plate by screws.

12. The grinding sander according to claim 1, wherein the hook and loop fastener is a one-piece member.

13. The grinding sander according to claim 1, wherein an aspect ratio (length to width) of the strip-shaped slot area is larger than 5 to 1.

14. The grinding sander according to claim 1, wherein the strip-shaped sandpaper is adhesively secured to the bottom of the strip-shaped slot area.

15. The grinding sander according to claim 1, wherein the grinding sander is a flat plate sander, the sanding plate is a plane, and the movement comprises vibration in the plane.

16. The grinding sander according to claim 1, wherein the grinding sander is a pneumatic sander.

* * * * *